US007080533B2

(12) United States Patent
Sedley

(10) Patent No.: US 7,080,533 B2
(45) Date of Patent: Jul. 25, 2006

(54) LOCK AND MAGNETICALLY CODED CARD

(76) Inventor: Bruce Samuel Sedley, 2817 Milo Hae Loop Koloa, Kauai, HI (US) 96756

( * ) Notice: Subject to any disclaimer, the term of this patent is extended or adjusted under 35 U.S.C. 154(b) by 0 days.

(21) Appl. No.: 10/864,416

(22) Filed: Jun. 10, 2004

(65) Prior Publication Data

US 2004/0231378 A1 Nov. 25, 2004

Related U.S. Application Data

(63) Continuation-in-part of application No. 10/443,818, filed on May 23, 2003, now Pat. No. 6,840,071.

(51) Int. Cl.
*E05B 47/00* (2006.01)

(52) U.S. Cl. ..... 70/276; 70/387; 70/413

(58) Field of Classification Search ..... 70/276, 70/352, 413, 387, 389, 390, 429
See application file for complete search history.

(56) References Cited

U.S. PATENT DOCUMENTS

| | | | | | |
|---|---|---|---|---|---|
| 3,403,380 | A * | 9/1968 | Welch | 235/380 |
| 3,595,042 | A * | 7/1971 | Sedley | 70/276 |
| 3,855,827 | A * | 12/1974 | Hallman et al. | 70/134 |
| 3,995,460 | A | 12/1976 | Sedley | 70/240 |
| 4,133,194 | A | 1/1979 | Sedley et al. | 70/222 |
| 4,253,320 | A * | 3/1981 | Schwab et al. | 70/276 |
| 4,338,805 | A * | 7/1982 | Nygren | 70/134 |
| 4,398,404 | A * | 8/1983 | Wake | 70/276 |
| 4,572,348 | A * | 2/1986 | Eisermann et al. | 194/248 |
| 4,918,957 | A | 4/1990 | Eisermann | 70/276 |
| 5,181,406 | A * | 1/1993 | Wolter | 70/337 |
| 5,212,974 | A * | 5/1993 | Shen | 70/352 |
| 5,291,766 | A | 3/1994 | Eisermann | 70/276 |
| 5,655,395 | A | 8/1997 | Merchel | 70/387 |
| 5,664,449 | A | 9/1997 | Sedley | 70/276 |
| 5,884,511 | A * | 3/1999 | Preddey | 70/350 |
| 6,474,121 | B1 | 11/2002 | Sakai et al. | 70/276 |
| 6,526,791 | B1 * | 3/2003 | Shvarts | 70/419 |
| 6,637,243 | B1 * | 10/2003 | Lemley et al. | 70/56 |
| 6,840,071 | B1 * | 1/2005 | Sedley | 70/276 |

FOREIGN PATENT DOCUMENTS

| | | | | |
|---|---|---|---|---|
| EP | 0 024 242 | | 2/1981 | |
| JP | 405113064 A | * | 5/1993 | 70/387 |

* cited by examiner

*Primary Examiner*—Lloyd A. Gall
(74) *Attorney, Agent, or Firm*—Leydig, Voit & Mayer, Ltd.

(57) ABSTRACT

A magnetically coded card and a lock include a slot into which the card is inserted to operate the lock. The card has an aperture through which a card-impaling lock-in pin of the lock can pass when the card is fully inserted within the slot, thus retaining the card in the slot when the lock is unlocked and releasing the card when the lock is again locked.

11 Claims, 6 Drawing Sheets

LOCK AND MAGNETICALLY CODED CARD

This is a Continuation-in-Part application of U.S. patent application Ser. No. 10/443,818 filed on May 23, 2003, now U.S. Pat. No. 6,840,071, which is incorporated herein by reference.

FIELD OF THE INVENTION

The invention relates to magnetic cards or keys for operating magnetic locks.

Such locks are already known and described for example in European Patents EP 0241323, 0024242, 0498465 and U.S. Pat. No. 3,995,460. The present invention relates to coded magnetic cards to operate such locks as described in the applicant's U.S. Pat. Nos. 3,611,763 and 4,077,242, the latter titled Metal Magnetic Key. Another is U.S. Pat. No. 3,995,460 describing an embodiment with a hole in the card being impaled by a pivoting pin. That pin however impales the card as the card is being inserted and not as the housing is being rotated as is the case in present embodiments to be described in detail herein.

To operate the prior locks, a coded magnetic card or key is inserted in the lock to unlock the lock and allow a door, gate or other barrier to be opened. Typically, the card must remain in the lock during unlocking but can be removed when the lock is unlocked. An externally exposed slot is provided for the card in a periphery of an exposed rotatable or fixed position body. The body may be, or form part of, a door catch release knob or handle that allows the magnetic card to be slidingly inserted. Without any inserted card, the lock housing with card slot may be free-turning, through 360 degrees. That is, only without an inserted card is the housing free-turning. The card slot may come to rest at a rotational position not convenient for subsequent card insertion. That random position may not be readily adjustable. It is desirable for the slot to be positioned uppermost for most convenient card insertion and easy visibility of the slot. However, when the lock is used externally in a building or in the open, for a gate way, an uppermost slot exposes the inside of the lock to rain, external surface water, debris and dirt so a side or bottom slot position is preferable.

In certain applications the magnetic card is retained in the lock during unlocking and locking, so it is not necessary to hold the card in place while rotating the lock body; the card being removable by pulling it out of the slot. However, there is sometimes a requirement that the card should not be removed when the locking mechanism is unlocked as it is not to be left in an unlocked mode. Means to adjust the slot position, return it to a selected null position when the card is removed and lock-in the inserted card when the lock is unlocked are disclosed in the parent case to which this application is a Continuation-in-Part.

If a standard type card containing an aperture to receive a lock-in pin is inserted into the slot of the card lock-in mechanisms described in the parent case and the user slightly releases pressure on it while rotating the housing, the card lock-in pin in the lock will jam against the card in a location other than the location of the pin aperture. This could make an unwanted depression in the card which could prevent the card from being easily withdrawn from the slot and further pressure could damage the card or the mechanism.

Also when the card is retained in the housing of such a lock, it is desirable to be able to release finger pressure on the inserted card when the housing is first rotated.

OBJECT OF THE INVENTION

It is the object of the present invention to provide a magnetically coded card that overcomes or substantially ameliorates one or more of the above disadvantages.

DISCLOSURE OF THE INVENTION

According to one aspect of the invention there is provided a magnetically coded card for use with the disclosed locks and comprising at least one dimple projecting therefrom and engaging with the slot upon insertion therein and providing resistance against removal from the slot.

The magnetically coded card typically comprises an aperture through which a card-impaling lock-in pin of the lock can pass when the card is fully inserted within the slot.

According to another aspect of the invention, there is provided a magnetically coded card for use with a lock having a slot into which the card is inserted to operate the lock, comprising an aperture for impaling by a card lock-in pin of the lock when the lock housing is subsequently rotated.

The lock would comprise means to hold the card fully inserted prior to rotation of the housing.

The magnetically coded card might further comprise at least one-dimple projecting therefrom and engaging with the slot upon insertion therein and providing resistance against removal of the card from the slot.

There is further disclosed herein a magnetically coded card for use with a lock having a slot into which the card is inserted to operate the lock, and an aperture through which a card-impaling lock-in pin or actuator pin of the lock can pass when the card is fully inserted within the slot, the card comprising a magnetic insert between a hard magnetic sheet and a soft non-magnetic sheet, the hard magnetic sheet having a large opening at the card aperture, and the non-magnetic sheet having a smaller opening flared into the card aperture.

Preferably, the hard magnetic sheet is made of metal.

There is further disclosed herein a combination comprising, a lock and a magnetically coded card, the lock comprising a slot into which the card is inserted to operate the lock, and a latching button extending into the slot, the card comprising an aperture for impaling by the latching button when the card is fully inserted within the slot, the aperture having openings of different dimension at each side of the card.

Preferably, the button has a bevelled upper surface to allow the card to pass by the button when force is applied to the card.

Preferably, the button is made of hardened steel.

Preferably, the lock further comprises a spring base having a spring leaf extending therefrom and on which the latching button is located.

Preferably, the lock further comprises a magnetic shield plate, a non-magnetic cover plate, and a spring plate having a hole therethrough and through which the latching button extends, the spring plate biasing the magnetic shield plate into contact with the non-magnetic cover plate to keep the slot closed when there is no card in the slot.

There is further disclosed herein a combination comprising a lock and a magnetically coded card, the lock comprising a slot into which the card is inserted to operate the lock, and a latching button extending into the slot, the card comprising a magnetic insert between a hard magnetic sheet and a soft non-magnetic sheet, the card having an aperture therethrough, the hard magnetic sheet having a large opening at the aperture, and the non-magnetic sheet having a smaller opening flared into the aperture.

BRIEF DESCRIPTION OF THE DRAWINGS

Preferred locks with which the magnetically coded card can be used, and preferred forms of the card itself will now be described by way of example with reference to the accompanying drawings, wherein.

DESCRIPTION OF THE PREFERRED EMBODIMENTS

Figure 1:
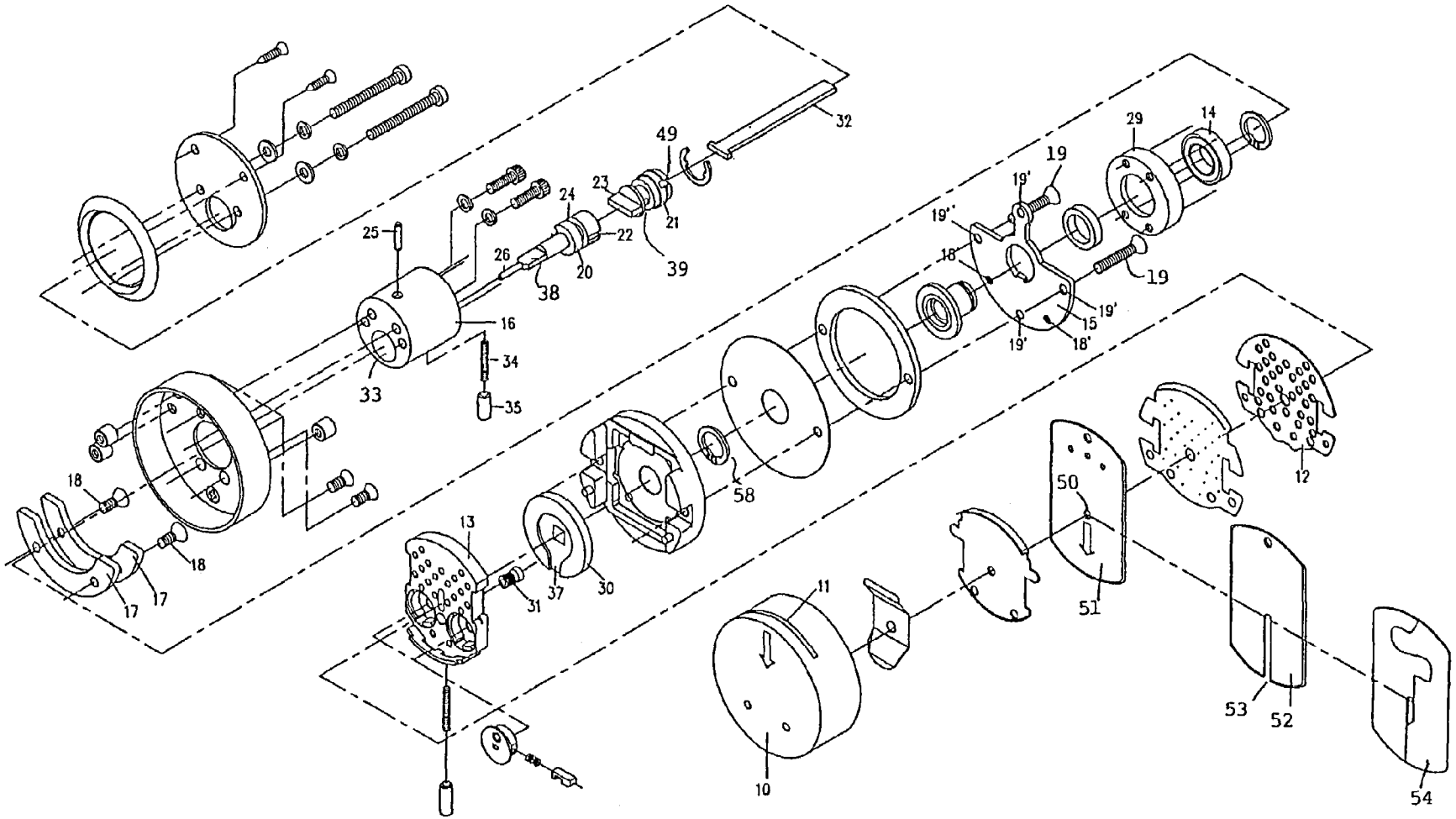
FIG. 1 is a schematic parts-exploded perspective illustration of a magnetic card-operated lock.
Figure 2A:
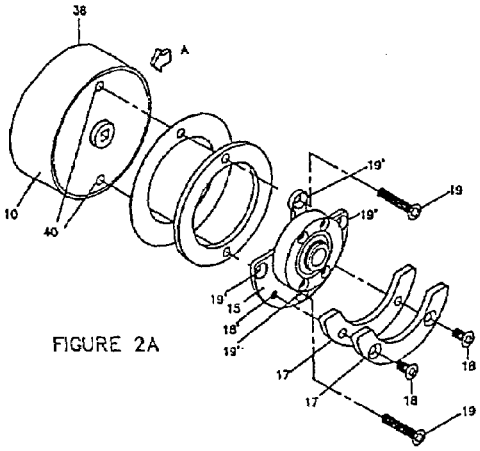
FIG. 2A is a schematic parts-exploded perspective illustration of parts of the locking mechanism showing the configuration of the weights to position the card slot sideways for a left-handed door.
Figure 2B:
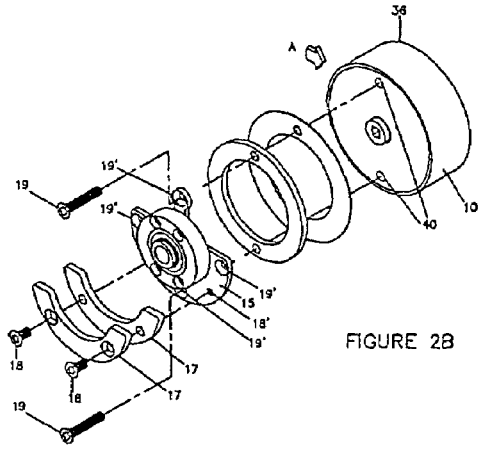
FIG. 2B is a schematic parts-exploded perspective illustration of parts of the locking mechanism showing the configuration of the weights to position the card slot sideways for a right-handed door.
Figure 2C:
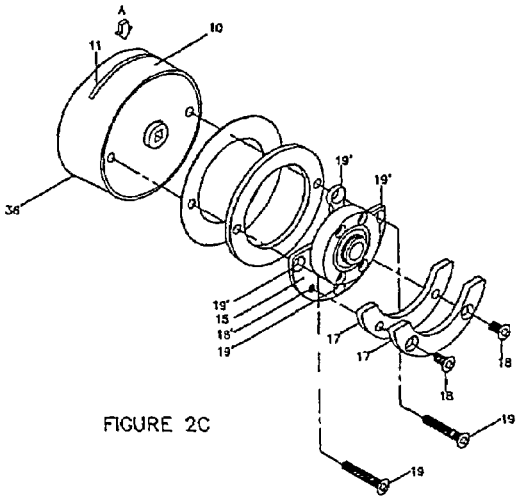
FIG. 2C is a schematic parts-exploded perspective illustration of parts of the locking mechanism showing the configuration of the weights to position the card slot upward for a right-handed door.
Figure 2D:
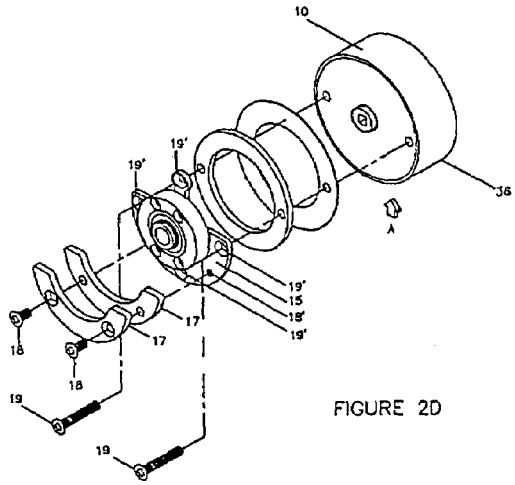
FIG. 2D is a schematic parts-exploded perspective illustration of parts of the locking mechanism showing the configuration of the weights to position the card slot downward for a right-handed door.

Referring to the drawings, in FIG. 1 various components of the lock are shown which are not directly relevant to the present invention and so will not be specially mentioned in the description. More relevant, the lock has a cover 10 with a peripheral slot 11 for receiving a magnetic card 51. The cover 10 and principal components of the lock, including a lock plate 12 and a magnet pin tumbler carrying lock core 13, are mounted on a friction free bearing 14 to rotate, together with a securing plate 15, about a common fixed central axis of the lock and a bearing bushing 29. In order to operate the lock, a correctly magnetically coded card 51 is inserted in the slot 11 and then the cover 10 (and internal mechanism) is rotated through the arc, typically 90° or more, in a manner already well-known. At the same time, a card tailpiece actuator 20 is engaged and is also rotated. It functions in a manner to be described more fully below.

A null rotational position for the free-turning cover 10 is determined by two semi-circular weights 17 that are fixed by screws 18 to the securing plate 15 in holes 18'. In the FIGS. 1 and 2C the null position of the cover 10 is arranged so that the slot 11 is uppermost. However, the securing plate 15 is provided with four screw holes 19' (FIG. 2) so as to be secured in any one of four rotational positions. Thus, the slot 11 can be set to come to rest due to the gravitational force on the weights either at the top as shown, or facing to the left (FIG. 2A), to the right (FIG. 2B) or downwards (FIG. 2D) according to the position of the weights relative to the lock housing 36 (FIG. 2). Thus, as pictured, four null positions for the slot 11 can be chosen. In each case the lock is operated in the same manner as before, that is by inserting a correctly coded magnetic card into the slot 11 to "unlock" the lock, and rotating the cover 10 from the null position. When the card is removed the weights return the slot to the null position. It will be appreciated that it is a simple matter to change the position of the weights at any time if a different null position is required.

The described lock can also include a card lock-in mechanism (FIG. 1), that includes a fixed body 16, the lock actuator 20 and a tail piece driver 21 that operates a connected lock set (not shown) to extend and retract a latch and/or bolt so that a door can be opened or secured. The actuator 20 and the tailpiece driver 21 are mechanically coupled by a slot 22 in the rear face of the actuator that receives a flat finger 23 extending from the front face of the tailpiece driver 21. Mechanical coupling between the slot 22 and the finger 23 is maintained effective even when the actuator moves a limited distance axially away from or towards the tailpiece driver. Both components 20 and 21 are contained within 1 through-hole 33 in the body 16.

The actuator 20 has a peripheral spiral groove 24 into which a remote end of a fixed pin 25 in body 16 is located. The pin extends into the hole 33 to engage in the groove 24. As a result, turning the cover 10 with a correctly coded card fully inserted and the tumbler carrying core 13 depressed, a driver pin 31 in the rear surface of core 13 engages a notch 37 in disc 30 which in turn rotates a flat portion 38 of the actuator 20 inserted into the axis slot of the disc 30. This rotates the actuator 20 to move-axially through the body 16 towards the card slot 11 due to the fixed pin 25 in spiral groove 24. A pointed finger 26 on the front of the actuator 20 enters and extends through a hole 50 provided in the inserted card 51 and thereafter prevents the card being pulled out of the slot 11 as the lock is unlocked. The card cannot be removed until the lock is again locked when the above action is reversed. That is, the card and slot is rotated in the opposite direction retracting the finger 26 from the centre hole 50 in the inserted card 51. Then the actuator 20 is moved, by relative rotation of the groove 24 and the fixed pin 25, towards the tailpiece driver 21.

The slot 22 of tailpiece actuator 20 is axially movable over the flat finger 23 of the tailpiece driver 21. The formed end of the tailpiece 32 is received within a slot 49 in the rear surface of the driver 21. The tailpiece 32 can be provided with a number of transverse lines of weakness (not shown) enabling the tailpiece to be snapped into the required length by the lock installer to fit doors of various thickness. The tailpiece 32 rotates upon rotation of the driver 20 to thereby operate a lock (not shown) into which it extends.

There is a spring 34 and plunger 35 fitted within the body 16 that serves to prevent inadvertent rotational movement of the tailpiece 32 by the end of the plunger 35 pressing on a flat area of groove 39 around the circumference of tailpiece driver 21. This feature prevents inadvertent locking or unlocking of the connected lock mechanism that might occur prematurely should the tailpiece 32 be allowed to rotate freely.

Should it be desirable to provide means to leave the lock in the unlocked mode, a coded unlocking card 52 is used. Such an unlocking card is formed with an open slot 53, extending from a bottom edge of the card to and including the area of the central hole 50 in the card, to straddle the extended finger 26. Such an unlocking card may be used to unlock the lock and then be removed in the unlocked position because the open slot 53 allows the card to be withdrawn from the slot 11 with the finger 26 extended, leaving the lock in the unlocked mode. The unlocking card must also be used for locking the lock if it has been left unlocked, because a normal card cannot be fully inserted in the slot 11 due to the extended finger 26. In this case the cover 10 must first be rotated to the position of the card slot when the unlocking card was removed, then the unlocking card 52 can be inserted and the mechanism operated and the lock housing 36 rotated back to the locked mode where the finger 26 is retracted out of the slot 53 in the card. Then the unlocking card is removed.

The above described unlocking card as well as a second embodiment of the unlocking card is shown in the applicant's European Patent EP 0024242. A two-piece card 54 is inserted into the unlocked lock seriatim when the finger 26 is extended across card slot 11 then the two pieces are fitted together in the slot 11. When both sides are joined around the finger 26, the lock can be actuated and the housing 36 rotated back to the locked mode where the finger 26 is retracted from slot 11 and the card can be removed in one piece.

FIGS. 2A to 2D illustrate how the cylinder code module 36 (comprising parts 10, 11 etc) can be biased into a selected orientation by choice of attachment positions of the weighted securing plate 15. Arrow A in each of the figures indicates the insertion direction of the magnetically coded card into the cylinder code module. That is, the card-insertion slot 11 can face upwardly, downwardly, left or right, or any angle in between. The two pre-tapped holes 40 in the cylinder code module cover 10 receive screws 19 by which the securing plate 15 is mounted thereto. The weights 17 attached to the securing plate 15 will bias the card-insertion slot 11 into the desired null-orientation by gravity. Four of such positions are depicted.

Figure 3:
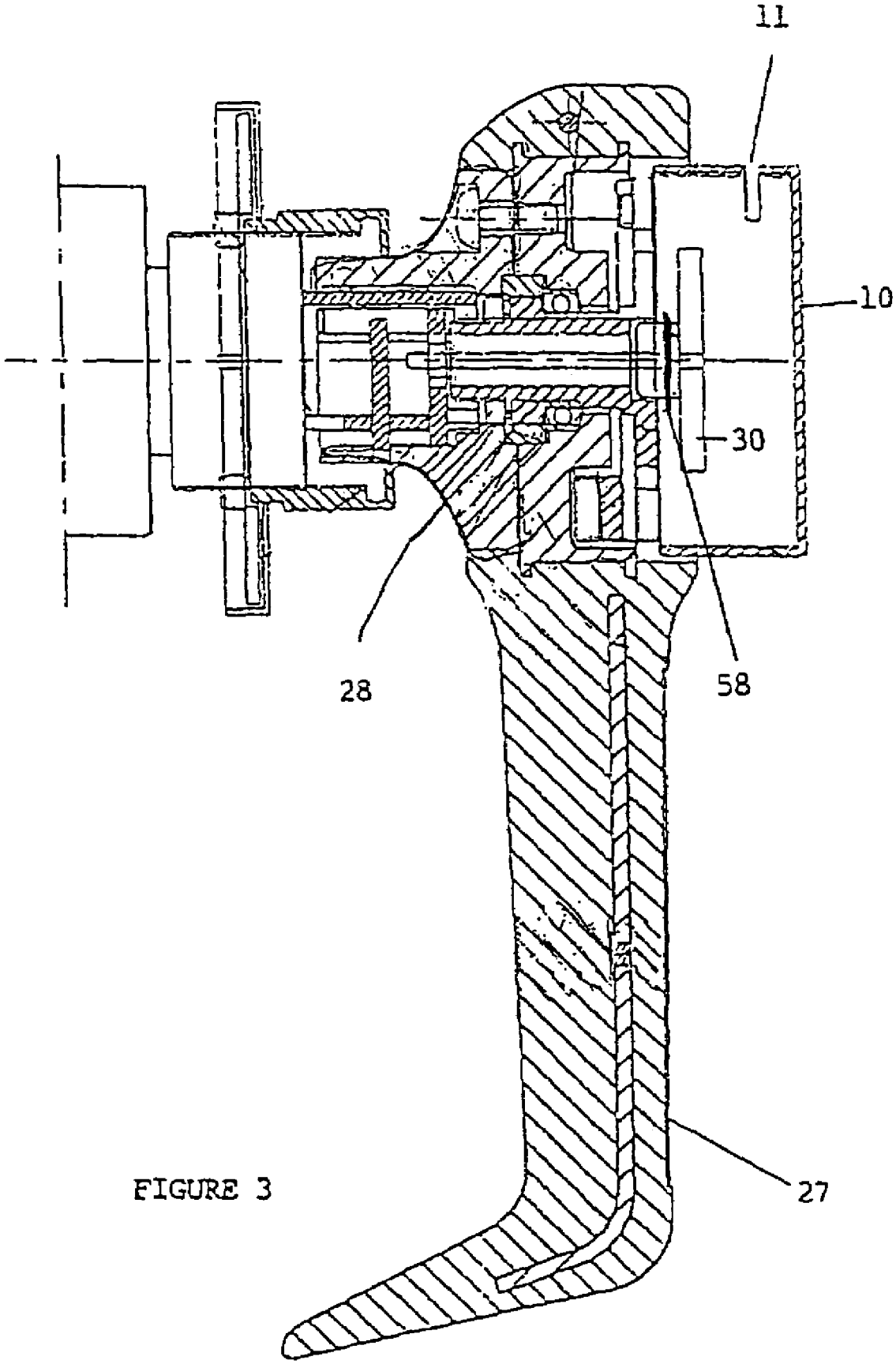
FIG. 3 is a schematic cross-sectional view of a door handle incorporating a similar magnetic card-operated weighted card slot lock.

In FIG. 3, a lock similar to the lock of FIG. 2A-2D is mounted in a cylindrical lock door operating handle 27 having the rotatable cover 10 and slot 11 as before. The cover is oriented to a chosen position by weights in the manner described above. An important feature of the arrangement of FIG. 3 is a central lock spindle adapter 28 that can be provided to fit different lock spindle dimensions. This enables the same handle 27 to be used with different lock mechanisms or for such handles already installed on locks to be replaced with a magnetic card-operated lock/handle. It is particularly important that the slot 11 can be set to any desired rotational null positioning by selective positioning of the weights 17. As a result, the lock can be provided with a keyed handle mounted on a left side or a right side of a door, and either inside or outside the door. In all positions the slot 11, can be automatically positioned as desired due to the selective positioning of the securing plate 15 with weights 17. If slot 11 is positioned either up or down no change is required for either left or right hand mounting as the slot remains in the desired position due to gravity when the handle points either right or left. For mounting with slot to either side, relocation of the securing plate with its attached weights is required. Such a handle lock can also contain a similar card Lock-in Mechanism as previously described.

Figures 4, 5:
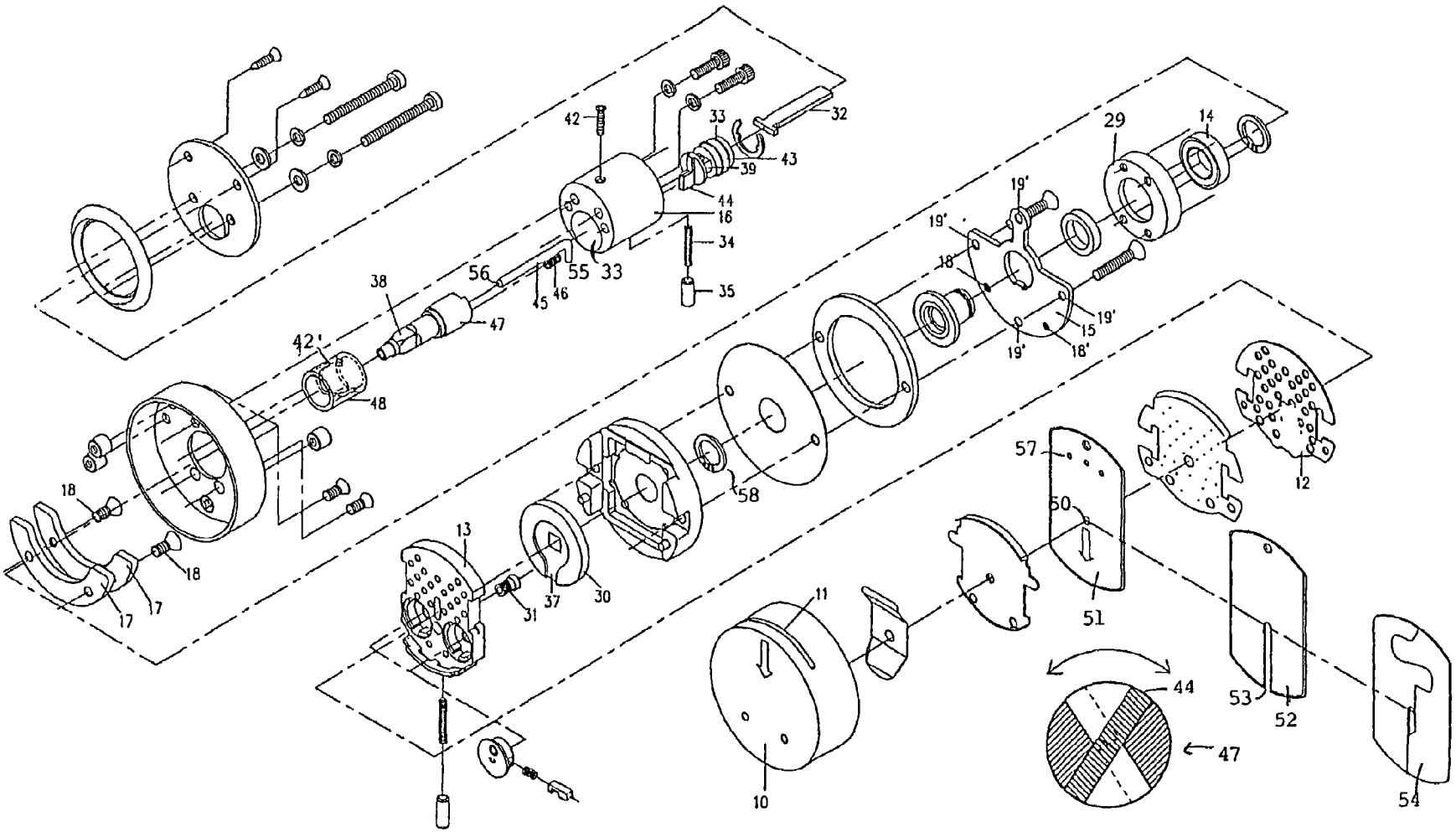
FIG. 4 is a schematic parts-exploded perspective illustration of one embodiment of a magnetic card-operated lock.
FIG. 5 is a schematic end elevational view of the tailpiece engagement parts of the lock of FIG. 4.

In FIGS. 4 and 5 of the accompanying drawings there is depicted schematically an improved card-lock-in device. In this alternative embodiment, the tip end 56 of the card lock-in pin 45 enters the hole 50 in the inserted card 51 before the lock mechanism begins to unlock the attached lock. This is achieved by moving only the card lock-in pin through the hole in the card at the start of rotation of housing assembly 36. The other components remain aligned in the body of the lock.

The card-lock-in pin 45 is L-shaped with its short rear end extending 90° radially. The longer part of the card lock-in pin 45 extends through actuator 47 that in turn is positioned for rotation in sleeve 48. The tailpiece actuator 47 and sleeve 48 are fitted within the longitudinal hole 33 through body 16. Rather than milling a spiral groove into the surface of the tailpiece actuator as in the embodiment of FIG. 1, there is a spiral slot cut through the wall of the sleeve 48. The tailpiece actuator 47 extends through the sleeve 48. The arc of the spiral slot in sleeve 48 only extends around half its circumference and this provides a more positive card lock-in pin movement. There is a spring 34 and plunger 35 that rides in the groove 39 of the tailpiece driver 43 as is the case with the embodiment of FIG. 1, serving to hold it in place and also to provide a detent flat surface to bias the tailpiece actuator to the "locked" position which is the starting point of rotation. There is a retention screw 42 passing radially through the body 16 to secure the sleeve 48 in place through hole 42'.

The tailpiece actuator 47 is slotted on one end with another slot on its side (not shown) to receive a spring 46 and the 90° bent over short end of card lock-in pin 45. There is an axial hole through the tailpiece actuator into which the longitudinal part of card lock-in pin 45 extends such that its tip 56 may pass through the hole 50 in magnetic card 51. As the card lock-in pin 45 moves forward such that its tip extends beyond the leading end of tailpiece actuator 38, the 90° bent over end of card lock-in pin 45 compresses the spring 46. That is, the spring urges the card lock-in pin 45 back to the starting position when the lock has returned to the locked mode.

The tailpiece driver 43 has an off-centre finger 44 extending from its front face. As shown in FIG. 5, the back end of the tailpiece actuator 47 has an hourglass shaped slot into which the finger 44 extends. The 90° bent end of the card lock-in pin 45 is also received in this slot. It should be noted that as a result of the configuration of FIG. 5, the tailpiece actuator 47 can rotate before contacting the finger 44 to begin rotation of the tailpiece driver 43 which unlocks the lock, this is termed "lazy cam" action. It allows the tip end 56 of the card lock-in pin 45 to enter hole 50 in card 51 to prevent its removal from card slot 11 as described in detail below.

The driver pin of the magnet-carrying core is normally positioned in the lower central area of the driver disc 30. When a correct card is inserted into the code module it moves the magnet-carrying core 13 of the module downwards. The driver pin 31 in the rear of that core moves down into the open slot 37 of the driver disc 30. Subsequent rotation of the code module 36 and core rotates the driver pin 31 which in turn rotates the driver disc 30. The square hole in the disc receives the square portion 38 of the tailpiece actuator so it also is rotated. As the tailpiece actuator 47 carries the bent card lock-in pin 45, the rotation causes the tip 55 of the pin to ride up the spiral slot in the sleeve 48 moving the pin forward into the card slot where it impales the card 51 through hole 50, preventing its removal. A circlip 58 prevents disc 30 from moving axially into contact with the rear surface of the magnet pin-carrying core 13, which could jam the mechanism. Reversing the rotation of the code module retracts the card lock-in pin 45 out of the hole 50 in the card and when fully retracted in the "locked" mode of the lock-in device, the card can be removed from the code module slot.

Although the card 51 is retained in the housing 36 as it is rotated, it is desirable to be able to release pressure on the inserted card when the housing is first rotated. To accomplish this the card 50 has stamped dimples 57 in its surface so that the initial pressure to insert the card will push the dimples fully into the slot 11 of cover 10 and hold the card in the fully inserted position as the housing is rotated. The dimples are pressed past the cover thickness at the card slot so they grip on the inside surface edge of the cover to offer resistance to the removal of the card.

FIGS. 6–9 show another method of holding in the inserted card without adding dimples to it.

In FIGS. 6–9 the card is of the same type as used with the dimples. It consists of an inner insert of a magnetic sheet material between two sheets of metal, the outer side being magnetic stainless steel and the inner side a non-magnetic material such as stainless steel, brass or aluminium. The use of the two different types of materials creates a card that can be encoded only on the non-magnetic side. The opposite side, being magnetic does not pass the magnetic fields of the internal encoded areas. It is a harder material than the opposing side. This non-magnetic side faces the magnetic pin tumblers in the lock. The harder side is usually stamped with an arrow to indicate which side is to be outwards when inserting the card in the slot. Such stamping must be made on the outside metal part before assembly of the card due to the hardness of the material. The non-magnetic side, being softer can be stamped with an individual serial number or other identification after manufacture. These features are important to the operation of the card lock-in mechanism to be described.

Although the card with dimples is quite practical, it takes more strength of the fingers to push the dimples past the card slot opening and if the same card is used in locks that do not have the card lock-in feature, the same strength is required to insert the card in those locks as well. Therefore an embodiment of a card that can be retained in the slot without the need for dimples is more acceptable in multi-lock systems.

Figure 6:
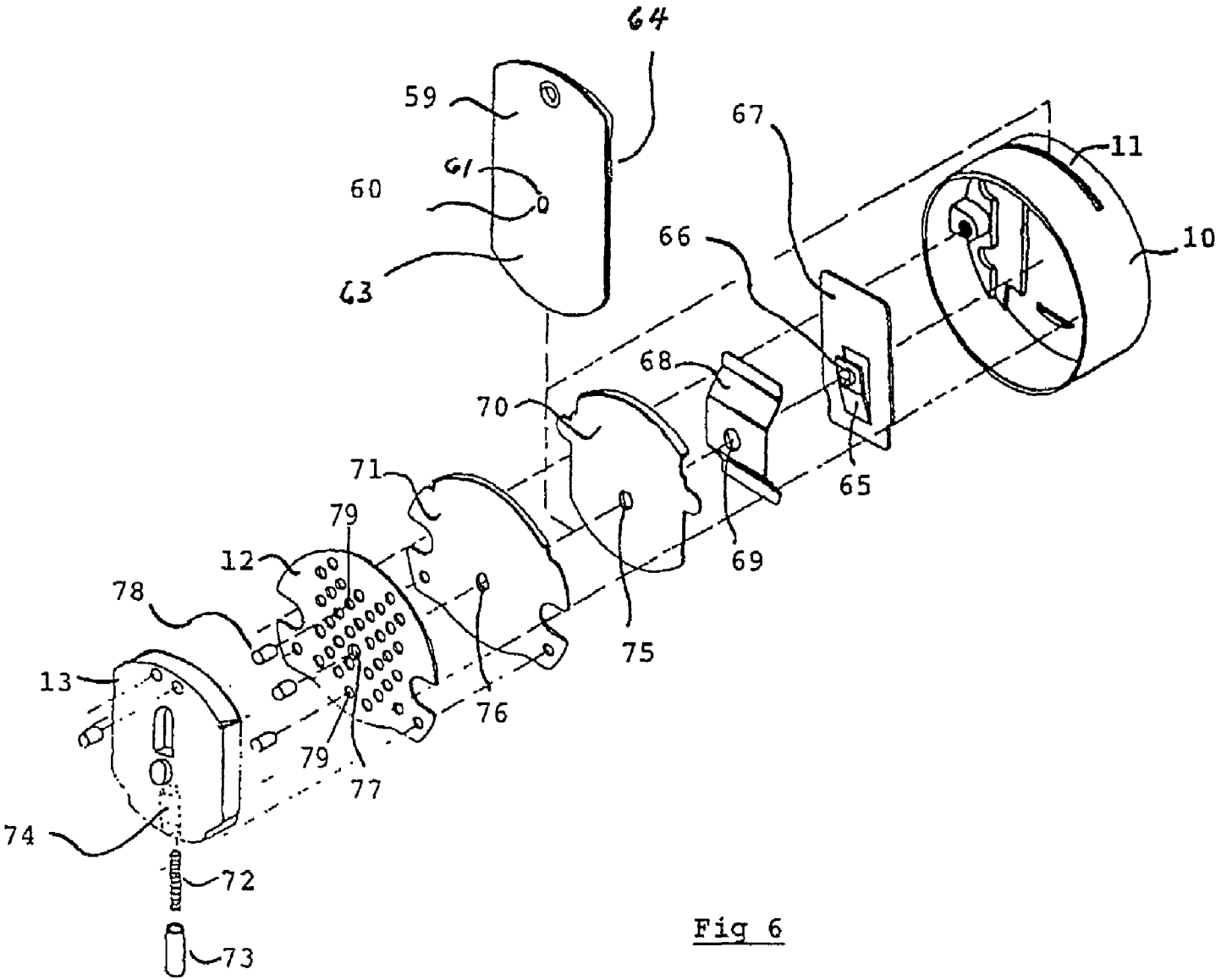
FIG. 6 is a schematic parts-exploded perspective illustration of means to hold-in the card using the same aperture in the card through which the lock-in pin passes.
Figure 9:
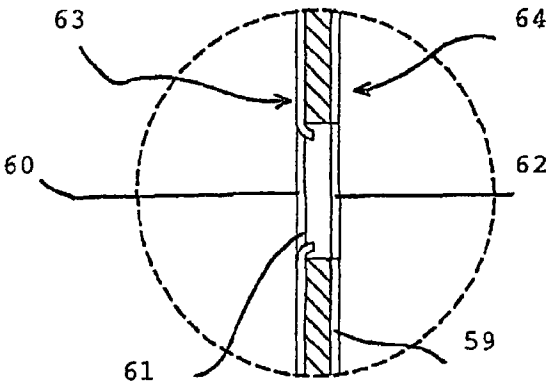
FIG. 9 is a cross section of a metal-clad card with hole for lock-in pin.

FIG. 6 shows such a card and mechanism in partial exploded view. The card 59 has a through-hole 60 with different diameter openings 61 and 62 on either side of card 59 as shown in detail in FIG. 9. The hole 60 accepts the tip end 56 of lock-in pin 45 or pin 26 of actuator 20 when the card is fully inserted into the card slot 11 of lock cover 10. The non-magnetic side 63 of the card 59 has the entry 61 flared into hole 60 in the card. The opposite side 64 of the card 59 is the harder material and has the larger diameter hole 62 in alignment with the smaller diameter flared hole 61 on the side 63 for a purpose to be described.

Figure 10:
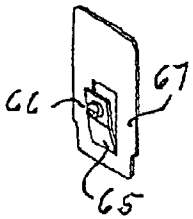
FIG. 10 is a schematic perspective illustration of a spring base from which there extends a spring leaf and latch button forming part of the mechanism depicted in FIGS. 7 and 8.

A spring base 67 with extended spring leaf 65 is located in the inside bottom of cover 10. This part is shown separately in FIG. 10. At the tip end of spring leaf 65 is affixed a hardened steel latching button 66. The button 66 extends through the hole 69 in the spring plate 68. The spring plate biases the magnetic steel shield plate 70 into contact with the non-magnetic cover plate 71 to keep the slot 11 closed when there is no inserted card. Plate 70 also serves to attract all the locking pin tumblers 78 in the core 13 into their respective locking holes 79 of the locking plate 12 thus keeping the lock locked when there is no card in the card slot.

The latching button 66 also passes through hole 75 in shield plate 70 into the card slot area and when there is no inserted card in the card slot 11, it also enters hole 76 in cover plate 71 and into hole 77 in lock plate 12. However when card 59 is being inserted into the card slot 11 it pushes back the latching button 66 to the surface of shield plate 70 and when fully inserted in the card slot 11 the latching button 66 passes through the hole 60 in card 59 to retain the card in the fully inserted position in the card slot 11.

Figure 7:
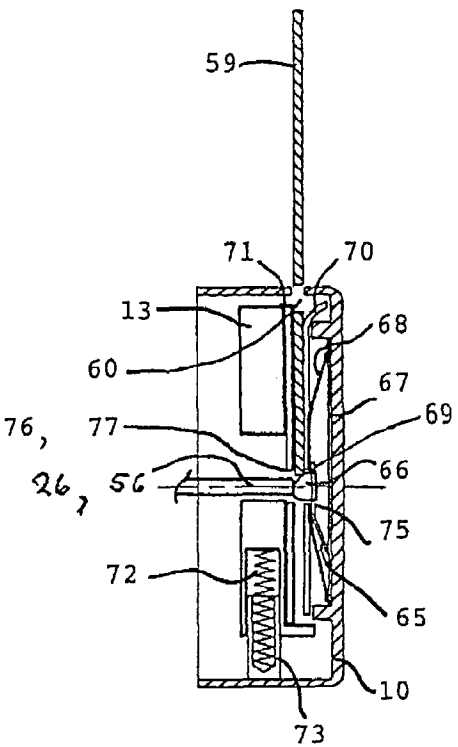
FIG. 7 is a cross sectional side view of the assembled lock of FIG. 6 as the card is being inserted.

FIG. 7 is a cross section side view of the assembled code module showing a card 59 partially inserted with its bottom end touching the latching button 66. Note that the upper surface of the button is bevelled to allow the card to pass by the button when slight added force is applied to the card.

Figure 8:
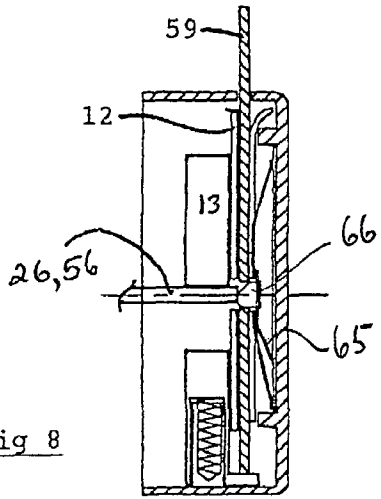
FIG. 8 is a similar view to FIG. 7 with the card fully inserted.

FIG. 8 is a similar cross section with the card 59 fully inserted and the internal magnet-carrying core 13 pushed down to its fully depressed position to unlock the lock. In so doing the coil spring 72 in plunger 73, used to return the core 13 to locked position, has been fully compressed into the hole 74 in the bottom of the core 13. To retain the card 59 fully inserted in the lock after the inserting force is removed requires a force greater than that of the compressed spring 72 which is biasing the core 13 back to the locked position. This larger force is supplied by the entry of the latching button 66 into the larger diameter hole 62 in the side 64 of the card 59 when the card is fully inserted into the lock. The contour of the bottom surface of the button 66 is formed to bear on the bottom edge of the hole 62 without allowing the hole to slip off the button, yet allow this slipping to occur when the card is withdrawn from the slot. As the repeated insertion of cards would cause unwanted wear on the button 66 and the hole 62, both are preferably made of sufficiently hard metal to withstand these actions without appreciable wear. Due to the required size of the latching button 66 the hole 62 is larger in diameter than the hole 61 on the opposite side 63 of the card 59.

The hole 61 has been flared in after assembly of the card to accept the tip 56 of the locking pin 45 or the pin 26 of the actuator 20. As those pins are a smaller diameter than the base of the latching button 66, a smaller hole 61 can be used. However the tip of the button 66 is sized to enter the smaller diameter hole 61 so it can extend completely through the hole 60 in the card 59.

The locking pin tips 56 or 26 could push the latching button 66 out of the hole 60 in card 59. If it does so the card 59 is still retained in the card slot 11. Ideally the pin tips should not push the button 66 completely out of the card hole 60. Partial insertion of the pin tips 56 or 26 into the card hole 60 is sufficient to retain the card in the slot. When the pin tips 56 or 26 are retracted from the card hole 60 the latching button 66 follows to continue to hold the card 59 in the fully inserted position until it is withdrawn from the card slot.

Thus has been described various types of cards with aperture for entry of a locking pin to retain the card in the card slot when the lock mechanism has been unlocked by rotation of the cover 10. Also an improved mechanism to hold-in a card prior to and after said rotation of the cover has extended and then retracted a locking pin through the card aperture.

It should be appreciated that modifications and alterations obvious to those skilled in the art are not to be considered as beyond the scope of the present invention.

The invention claimed is:

1. In combination, a lock and a magnetically coded card, the lock comprising a slot into which the card is inserted to operate the lock, and a latching button extending into the slot, the card comprising an aperture for impaling by the latching button when the card is fully inserted within the slot, the aperture having openings of different dimensions at each side of the card.

2. The combination of claim 1, wherein the latching button has a bevelled upper surface to allow the card to pass by the latching button when force is applied to the card.

3. The combination of claim 2, wherein the latching button is made of hardened steel.

4. In combination, a lock and a magnetically coded card, the lock comprising a slot into which the card is inserted to operate the lock, and a latching button extending into the slot, the card comprising an aperture for impaling by the latching button when the card is fully inserted within the slot, the aperture having openings of different dimensions at each side of the card, wherein the lock further comprises a spring base having a spring leaf extending therefrom and on which the latching button is located.

5. In combination, a lock and a magnetically coded card, the lock comprising a slot into which the card is inserted to operate the lock, and a latching button extending into the slot, the card comprising an aperture for impaling by the latching button when the card is fully inserted within the slot, the aperture having openings of different dimensions at each side of the card, wherein the lock further comprises a magnetic shield plate, a non-magnetic cover plate, and a spring plate having a hole therethrough and through which the latching button extends, the spring plate biasing the magnetic shield plate into contact with the non-magnetic cover plate to keep the slot closed when there is no card in the slot.

6. In combination, a lock and a magnetically coded card, the lock comprising a slot into which the card is inserted to operate the lock, and a latching button extending into the slot, the card comprising a magnetic insert between a hard magnetic sheet and a soft non-magnetic sheet, the card having an aperture therethrough, the hard magnetic sheet having a large opening at the aperture, and the non-magnetic sheet having a smaller opening flared into the aperture.

7. The combination of claim 6, wherein the latching button has a bevelled upper surface to allow the card to pass by the latching button when force is applied to the card.

8. The combination of claim 6, wherein the hard magnetic sheet is made of metal.

9. The combination of claim 6, wherein the latching button is made of hardened steel.

10. The combination of claim 6, wherein the lock further comprises a spring base having a spring leaf extending therefrom and on which the latching button is located.

11. The combination of claim 6, wherein the lock further comprises a magnetic shield plate, a non-magnetic cover plate, and a spring plate having a hole therethrough and through which the latching button extends, the spring plate biasing the magnetic shield plate into contact with the non-magnetic cover plate to keep the slot closed when there is no card in the slot.

* * * * *